United States Patent [19]

Miram et al.

[11] 3,963,955

[45] June 15, 1976

[54] MEANS AND METHOD FOR SUPPRESSING OSCILLATIONS IN ELECTRON GUNS

[75] Inventors: George V. Miram, Atherton; Gordon T. Hunter, Mountain View, both of Calif.

[73] Assignee: Varian Associates, Palo Alto, Calif.

[22] Filed: Apr. 15, 1974

[21] Appl. No.: 460,860

[52] U.S. Cl. ..... 315/5.34; 313/441; 313/446; 313/452; 313/456; 315/3.5

[51] Int. Cl.[2] ..... H01J 23/08

[58] Field of Search ..... 315/3.5, 5.34, 5.35; 313/441, 446, 452, 456

[56] References Cited

UNITED STATES PATENTS

| | | | |
|---|---|---|---|
| 2,831,141 | 4/1958 | Birdsall | 315/3.5 |
| 2,916,659 | 12/1959 | Sege | 315/5.34 |
| 3,227,913 | 1/1966 | Disman et al. | 315/3.5 |
| 3,374,389 | 3/1968 | Cahour et al. | 315/3.5 |
| 3,500,110 | 3/1970 | Winsor | 315/3.5 |

*Primary Examiner*—Saxfield Chatmon, Jr.
*Attorney, Agent, or Firm*—Stanley Z. Cole; David R. Pressman; Richard B. Nelson

[57] ABSTRACT

A method and apparatus for preventing oscillations in high-current electron guns. Spurious oscillations frequently occur as a result of interaction of the electron stream with the fields of resonant modes of the gun structure. The resonant impedances of the modes are lowered by damping with lossy dielectric or resistive materials which are suited to the high temperature and vacuum environment of electron guns. The lossy materials are located in places shielded from high electric fields applied to the gun. Lossy dielectric materials which are D.C. insulators may be used as insulating supports for gun electrodes.

7 Claims, 8 Drawing Figures

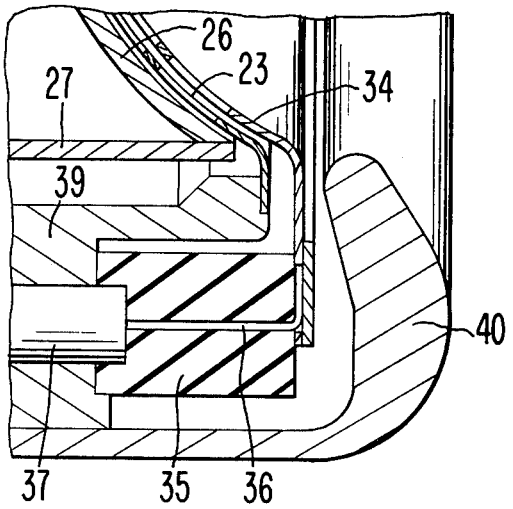
FIG. 4
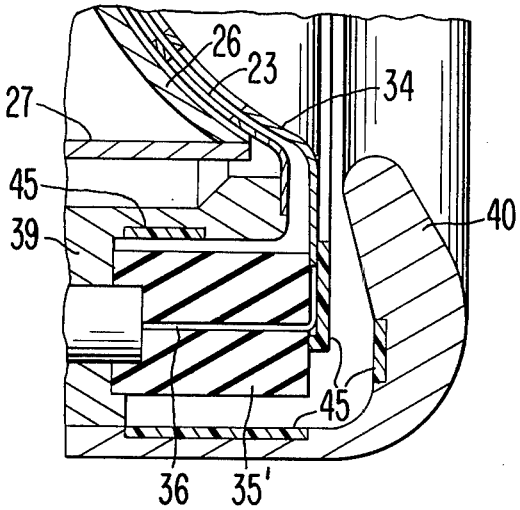
FIG. 5
FIG. 6
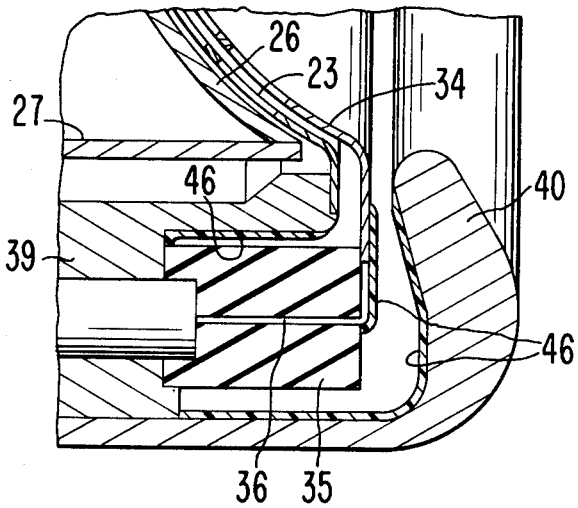
FIG. 7a
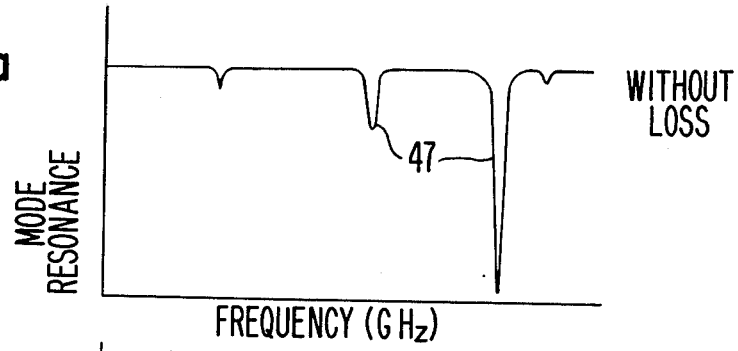
FIG. 7b
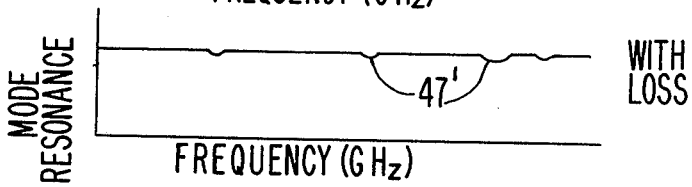

MEANS AND METHOD FOR SUPPRESSING OSCILLATIONS IN ELECTRON GUNS

FIELD OF INVENTION

This invention concerns high current electron guns, for example the guns producing cylindrical linear electron beams which are used in klystrons and traveling wave amplifier tubes. In such guns the electron beam is generated by a thermionic emitting cathode and passes through an aperture in the anode to emerge from the gun as a generally unidirectional beam which is then focused by a uniform magnetic field parallel to the beam's direction so as to maintain a uniform cylindrical beam diameter. Since a circular cylindrical beam is most useful, it is common to make all the electrodes figures of revolution about an axis along the center of the beam.

In many high power guns the cathode has a concave emitting surface, such as a portion of a hollow sphere, so that the electron stream is focused to a diameter smaller than the cathode and the beam current density is greater than the emission density of the cathode.

The theory and design of such guns is described in Chapter X of "Theory and Design of Electron Beams," by J. R. Pierce, D. Van Nostrand, New York, 1954 and in Chapter 5 of "Power Traveling Wave Tubes" by J. F. Gittins, American Elsivier, New York, 1965. As pointed out in these references, a given geometric arrangement of gun electrodes gives rise to a constant value of perveance $K = I/V^{3/2}$, where K is the perveance, I is the spacecharge-limited emission current, and V is the cathode-to-anode voltage. Typical guns have perveance values between $10^{-7}$ and $10^{-5}$ amperes per (volt$^{3/2}$).

The power in an electron beam is increased by raising the voltage; for a given perveance the power, $P = IV = KV^{5/2}$. The conductance G of the beam also increases with voltage, according to the formula $G = I/V = KV^{1/2}$. The conductance is a measure of the interaction of the beam with electromagnetic fields, such as the fields of a distributed electromagnetic circuit. It is apparent that at higher power levels this interaction is stronger and a circuit need have lower impedance to produce appreciable interaction with the beam.

Guns which are used to generate beams with power levels over a megawatt have often been troubled by spurious oscillations. The oscillations have been found to be caused by interaction between the electron stream and the electric fields of resonant modes of the support structure. These modes may have high Q-factors and hence high impedances at their resonant frequencies. The transfer of energy from the beam to the resonant mode fields can occur either by means of the negative resistance diode effect or by parts of the structure acting as a triode amplifier with feedback.

A space-charge limited diode may exhibit negative resistance between cathode and anode at high frequency. With a high enough resonant impedance between these electrodes the diode will oscillate. The phenomenon was described in "The Production of Ultra-high-frequency Oscillations by Means of Diodes" by J. B. Llewellyn and A. E. Bowen, Bell System Technical Journal, Vol. 18, p. 280, April 1939.

The triode oscillations arise when different parts of the gun are spaced apart for structural and thermal reasons, thereby providing partly enclosed volumes which can act as high frequency resonators, producing electric fields between the parts which can modulate the beam as a grid does. The problem of triode oscillations has become more acute now that actual control grids have come into use in linear beam guns. U.S. Pat. No. 3,558,967, issued Jan. 26, 1971 to George V. Miram, describes a high power gridded gun. With an insulated control grid all that is needed for oscillation is a suitable feedback means, as by capacity coupling between gun elements.

PRIOR ART

It has been commonly recognized by those skilled in the art that gun oscillations usually require a resonant mode of the structure to create a high enough impedance for oscillation to occur. FIG. 1 shows a structure susceptible to oscillation. The cathode and focus electrodes, in conjunction with the surrounding metallic envelope, form a coaxial circuit which can support standing wave modes, such as the $TEM_{1,1}$ mode. The support stem and its surrounding envelope, being of smaller diameter, form a coaxial line which is cut off for the $TEM_{1,1}$ mode at the frequency for which it is resonant in the cathode region. The mode is thus trapped in the cathode region and cannot propagate energy to the dielectric seal region where it would radiate into space, as from an antenna. In the absence of radiative energy loss the impedance of the mode is very high, whereby oscillations are probable.

One prior method of attempting to suppress oscillations in such modes involved increasing the size of the support stem and the surrounding envelope so the modes could propagate down the stem and radiate. Unfortunately, this method results in decreasing the spacings between members at cathode and anode potentials, thereby adversely affecting the ability of the structure to stand off high voltage. Other attempts have been made by cutting slots in the metal electrodes in positions to intercept the surface currents associated with the modes in order to introduce increased current dissipation and to perturb the field patterns of the modes and thus reduce their interaction with the electron stream. This method has had limited success because the loss introduced is not large and because distorting the field pattern of one mode often results in interaction with other modes which were previously harmless.

Other oscillatory modes which may occur in the structure shown in FIG. 1 involve, e.g., the partly enclosed chamber between the cathode and the focus electrode which can act as a simple coaxial resonator producing high frequency voltage between cathode and focus electrode. The latter then acts as a grid modulating the emission from the cathode. Prior attempts to control such oscillations have involved affixing conductive straps across the open end of the volume to short circuit the voltage and to raise the resonant frequency to a value too high for beam interaction. Such straps, to be completely effective, have the disadvantage of conducting heat from the cathode to another electrode which should be cold. Another disadvantage is that straps can not be used on an insulated control grid.

In radio-frequency interaction circuits, such as klystron cavities and traveling wave slow-wave circuits, unwanted oscillations have been damped by introducing lossy material at points where energy may be absorbed from the unwanted modes. For example, U.S. Pat. No. 3,381,163, issued Apr. 30, 1968 to A. D. LaRue and R. S. Symons, and 3,502,934, issued Mar.

24, 1970 to F. I. Friedlander and P. J. Spallas, disclose the loading of klystron cavities. The preferred material in the above-mentioned patents is Kanthal, an alloy of aluminum, chromium and iron, which is flame sprayed onto a base metal. High r.f. loss depends on a rough surface of metal particles interspersed with oxides. This surface cannot sustain high DC electric fields without arcing. Another lossy material used in traveling wave tubes is a porous ceramic infiltrated with carbon, which due to its porous structure would evolve gas at high temperatures typical of thermionic electron guns.

In these interaction circuits, the problem is much simplified because the entire structure is at the same DC potential and thus the DC properties and arcing resistance of the lossy material are not pertinent. Also, since the entire structure is cooled to approximate room temperature, the high temperature stability and outgassing properties of the lossy material are of relatively minor importance.

Thus the use of lossy materials in gun structures was not attempted; rather the awkward mechanical expedients described above were tried, with the disadvantages aforenoted.

OBJECTS

An object of the present invention is to provide an electron gun which is free of spurious oscillations.

A further object is to damp electron gun resonances by means which do not impair the high voltage holdoff properties of the gun.

A further object is to damp electron gun resonances by means which are stable and gas-free at high operating temperatures of the gun parts.

A further object is to damp electron gun resonances by means of structural parts of the gun support which serve as D.C. insulators between electrodes and simultaneously provide high loss to radio frequency fields of the resonances.

A further object is to provide an electron gun with an insulated grid in which oscillations are suppressed in the area between the grid support and the supports for other electrodes.

SUMMARY

The present invention comprises novel means for eliminating unwanted oscillations in electron guns. An electron gun is a structure which generates a stream of electrons which emerges from the gun and is utilized in some other region. Such streams are used in the interaction structure of a microwave tube, in a vacuum chamber in which materials are melted by the beam energy, in the target of an X-ray tube or as input current to a particle accelerator. The embodiments described here are such as used in a linear-beam microwave tube such as a klystron or traveling wave tube, but it is understood that the principles of the invention apply to many different structures suited to other forms and uses of electron guns.

As described above under "Prior Art," high power electron guns are frequently subject to radio frequency oscillations set up by interaction of the electron stream with the fields of electromagnetic resonances of the gun structure. According to the present invention we have discovered that it is possible to position material with high loss at radio frequencies, in the gun structure at regions where it absorbs energy from the electromagnetic fields and damps the oscillations, even though at such regions the lossy material is subject to the high operating temperatures of the gun parts.

A further feature of the invention is the novel use of a material which is a D.C. dielectric, as an insulating support between electrodes of the gun which operate at different potentials, the same material having high loss at radio frequencies and thus serving a second purpose of damping oscillations.

A material we have used successfully is a beryllium oxide ceramic containing discrete particles of silicon carbide.

Other methods of eliminating spurious gun oscillations have involved radiative loading of resonant modes and shortcircuiting conductors to raise the resonant frequencies so high that effective interaction with the electron stream ceases. In a gun with a control grid insulated from the cathode, these older methods have not been satisfactory for modes involving fields between the grid structure and the rest of the gun. A feature of our invention is that it can effectively damp such modes.

High D.C. electric fields often exist between cathode and anode of a gun. When the resonances involved are associated with recesses in the structure, as in the spaces between cathode and grid structure, it is advantageous that the lossy material be placed in those recesses shielded from the high D.C. fields.

The invention may best be understood by referring to the Figures, which illustrate the particular embodiments of guns for a high power linear beam microwave tube.

DRAWINGS

FIG. 4 is an enlarged section of a portion of FIG. 3.

FIG. 5 is an enlarged section of a portion of another embodiment of the invention.

FIG. 6 is an enlarged section of a portion of still another embodiment of the invention.

FIG. 7*a* is a plot of resonances of a grid support structure without lossy material.

FIG. 7*b* is a plot of resonances of the same structure with lossy material added according to this invention.

DESCRIPTION

Figure 1:
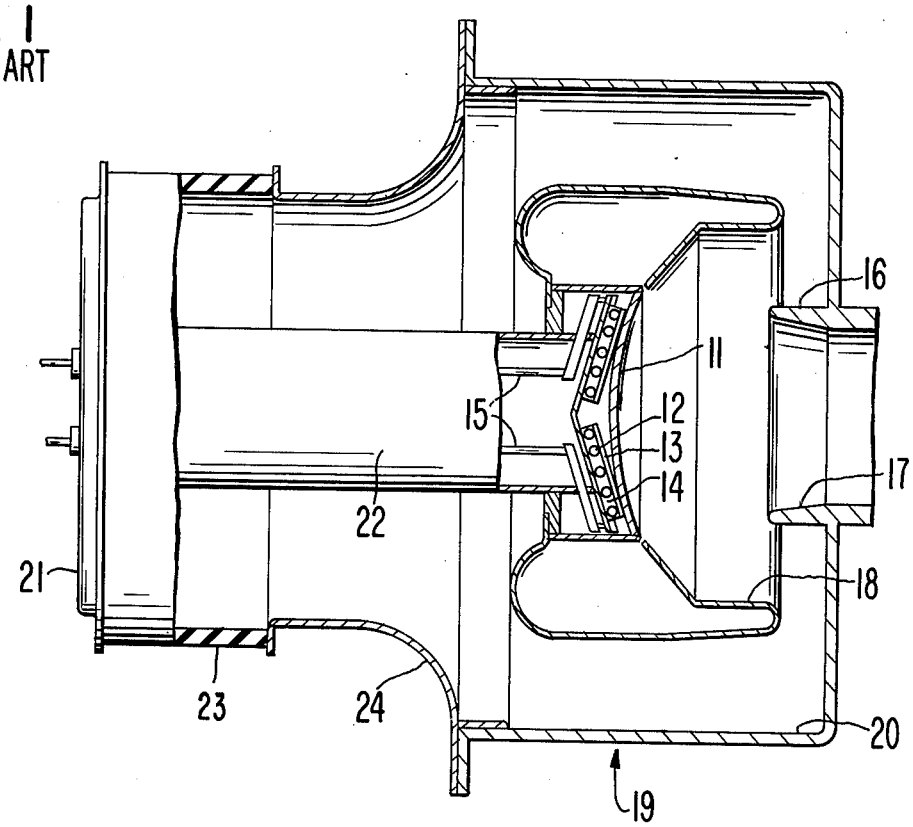
FIG. 1 PRIOR ART
FIG. 1 is a view, partly in cross section, of a prior-art gun of a type prone to oscillations.

FIG. 1 shows a typical prior art gun susceptible to oscillations. The gun comprises a concave thermionic cathode 11 heated by a coil of bare refractory metal wire 12 supported between ceramic blocks 13 and 14. Heating current enters by two insulated leads 15. The emitted electron stream is drawn toward a reentrant anode 16 and emerges from the gun through an aperture 17. Surrounding the cathode is a focus electrode 18 electrically connected to the cathode and shaped to direct the electron stream through aperture 17. The gun is enclosed in a vacuum envelope 19 comprising a metallic anode cup 20 which includes anode aperture 17 and which substantially surrounds the cathode and focus electrodes. A metallic header 21 supports the cathode structure via a post 22 smaller in diameter than the cathode-focus electrode assembly. Dielectric cylinder 23 is joined at one end to header 21 and at the other to the small end of a flared flange 24. After assembly of the cathode, heater, and focus electrode assembly, the outer end of flange 24 is joined, as by welding, to anode cup 20.

Figure 2:
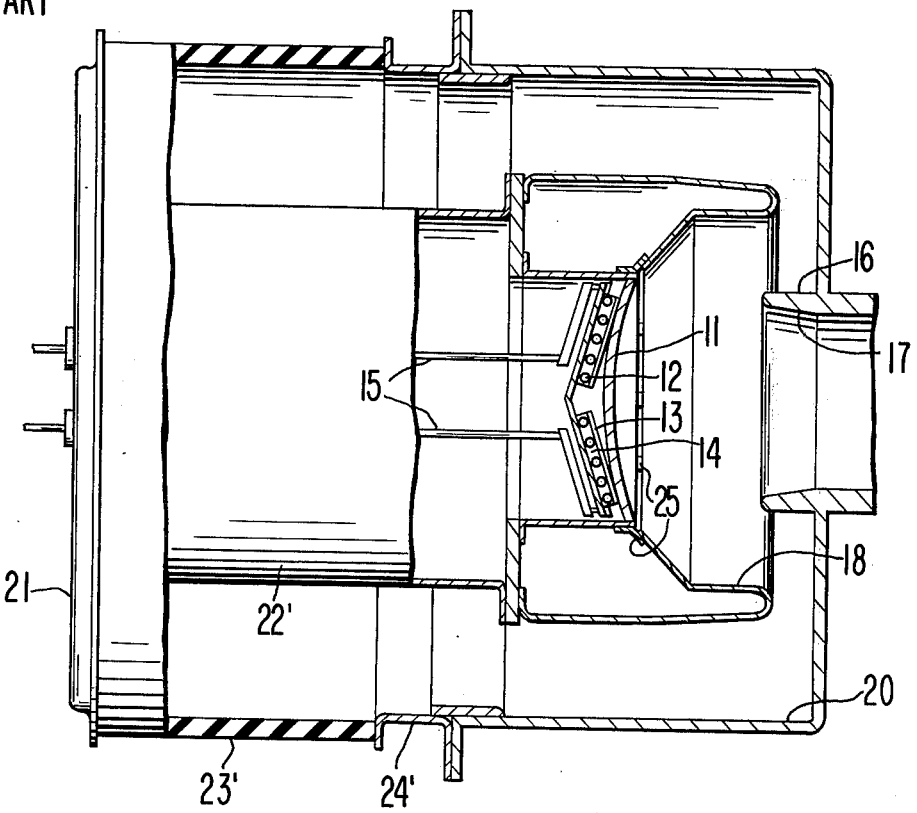
FIG. 2 PRIOR ART
FIG. 2 illustrates prior-art modifications of the gun of FIG. 1 such as were used to reduce oscillations.

FIG. 2 shows the gun of FIG. 1 modified according to prior-art methods attempting to suppress oscillations. Stem 22' has been enlarged in diameter. Dielectric cylinder 23' has been enlarged so that the inner end of flange 24' is almost as large as anode cup 20. Furthermore, the gap between the inner lip of focus electrode 18 and cathode 11 has been shortcircuited by a plurality of thin metallic tabs 25. Disadvantages of such prior-art methods are that many modes are not damped sufficiently, voltage holdoff is impaired, and the tabs drain heat from the cathode.

Figure 3:
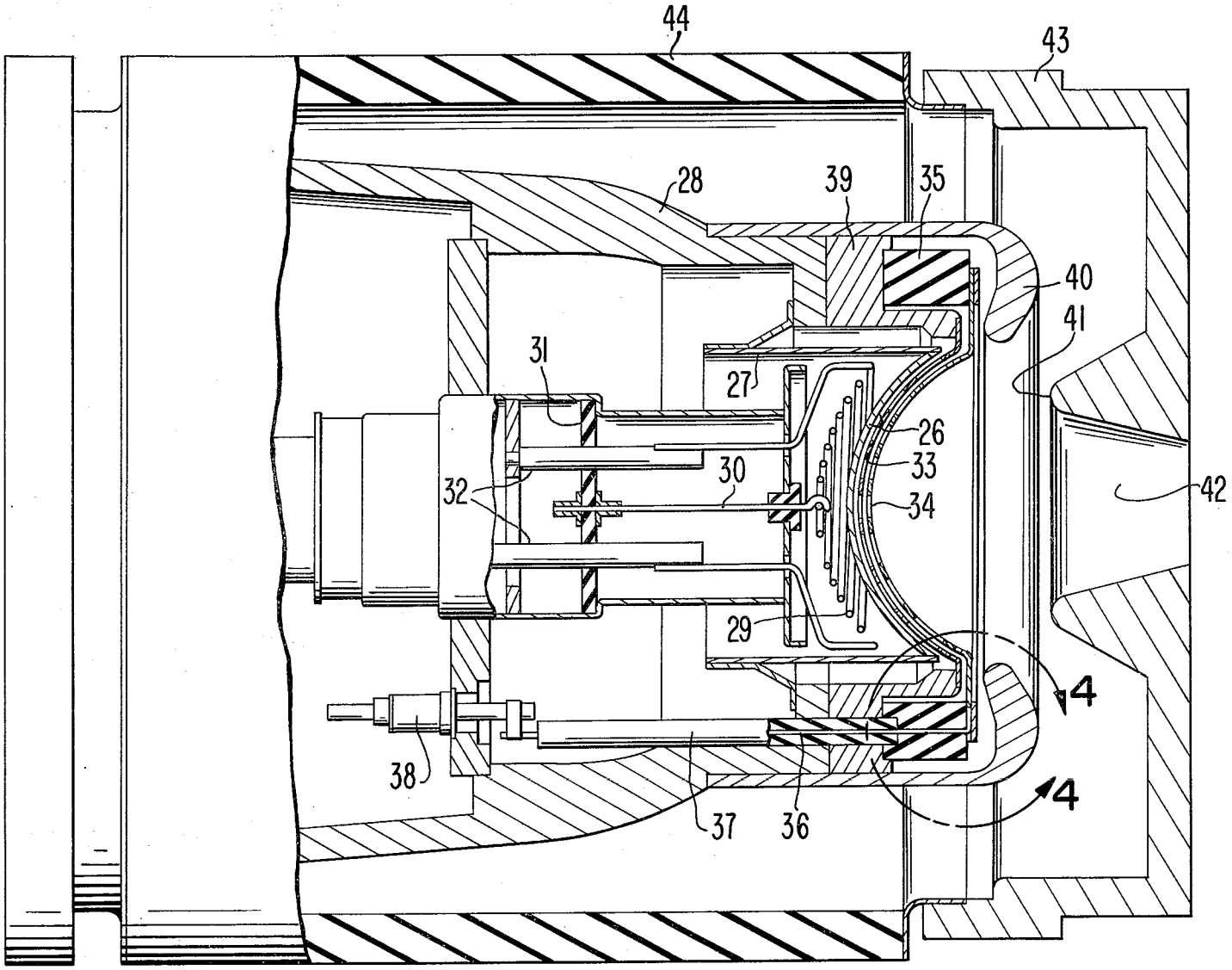
FIG. 3 is a view partly in cross section, of an embodiment of the present invention, a gridded gun for a linear beam tube.

FIG. 3 shows a gridded gun embodiment of the present invention and FIG. 4 is an enlarged section showing more clearly the grid support means of FIG. 3. A concave thermionic cathode emitter 26, as of porous tungsten impregnated with barium aluminate, is supported by a cylinder 27 of refractory metal, such as molybdenum, thin enough to retard conductive heat loss. Cylinder 27 is supported on a thick walled, thermally-conducting hollow cylindrical metallic member 28 whose base forms part of the vacuum envelope. Heater 29, of bare refractory metal wire such as tungsten, is supported in free space by a central insulated post 30 mounted on a perforated ceramic support disc 31 and by two insulated metallic legs 32 which conduct the filament heating current.

Spaced directly in front of cathode emitter 26 is a perforated "shadow" grid 33 electrically connected to cathode 26 and spaced in front of grid 33 is a perforated control grid 34. The perforations in both grids are aligned with respect to a radius from the center of curvature of the cathode. The grids are constructed of a refractory metal such as molybdenum-rhenium alloy.

Control grid 34 is mounted, as by brazing, on a ceramic ring 35 which is, in the preferred embodiment, at least partly made of a DC insulating material such as beryllia loaded with dispersed silicon carbide particles to provide loss at radio frequencies. Such a material is marketed by National Beryllia Co., Haskell, N. J., under the trademark "Carbelox." Electrical connection to control grid 34 is by a metallic wire 36 passing through a hole in ring 35, through a hollow tubular ceramic insulator 37 and through an insulated bushing 38 in the vacuum envelope.

Returning now to the grid support, ring 35 is brazed to a metallic ring 39, preferably of material matching the thermal expansion of the ceramic, such as an aggregate of tungsten and copper in correct proportions. Ring 39 in turn is mounted on support cylinder 28, as by brazing, to secure a mechanically rigid and thermally conducting structure. Shadow grid 33 is mounted in electrical and thermal conducting manner on ring 39. A focus electrode 40, as of austenitic stainless steel, projects in front of the grid structure and is also mounted on cylinder 28.

A re-entrant anode 41 faces the cathode structure. It has a central aperture 42 through which the electron stream leaves the gun. Around the anode is a metallic cup 43 forming part of the vacuum envelope. A high voltage insulating cylinder 44, as of alumina ceramic, is sealed between cup 43 and cathode support cylinder 28 to complete the vacuum envelope and support the gun parts in spaced, insulated relationship.

FIG. 5 is a section corresponding to FIG. 4 but of another embodiment of the invention. The grid support ceramic 35' is of conventional, low loss ceramic such as pure beryllium oxide. Rings of lossy dielectric material 45 are affixed to the metallic electrodes in areas where spurious resonances are likely to have high r.f. fields, and where the rings are shielded from high D.C. fields between cathode and anode.

FIG. 6 is a corresponding section of still another embodiment where, instead of using dielectric material, surfaces 46 of the electrode are coated, as by metal spraying, with a conductive material having high resistivity to r.f. surface currents. A suitable material is Kanthal, as previously described. In this embodiment, the lossy material is also shielded from high D.C. fields by the surrounding electrodes.

OPERATION

The effectiveness of the present invention in the operation of an electron gun is illustrated by FIGS. 7*a* and 7*b*. Since oscillations of a completed gun occur in a high vacuum environment when high voltages are applied, it is very difficult to probe the oscillations directly to determine their exact nature. A useful technique for identifying oscillations is to measure the resonances of the cold structure and compare them with the frequencies of observed oscillations. FIG. 7*a* shows some measured resonances of a gun similar to that illustrated in FIG. 3, designed to operate at 120kV with a perveance of $2.0 \times 10^{-6}$ amperes per volt $^{3/2}$. When the cold structure is excited with a swept frequency and the resultant field is measured with a probe, the dips 47 in the graph are a measure of the resonances.

FIG. 7*a* shows the resonances when the grid support ceramic was pure beryllia. When the same structure was altered to comprise a lossy ceramic grid support as in FIG. 3, the resonances 47' were highly damped as shown in FIG. 7*b*. When this gun was used in a high power klystron, it was shown to be remarkably stable.

The embodiments of our invention illustrated by FIG. 5 and FIG. 6 have the same operational result as the previously described structure illustrated by FIG. 3, since the pertinent result in each embodiment is to dissipate energy from the fields of possible oscillating resonance modes. The energy is dissipated in the structure illustrated by FIG. 5 through dielectric loss and in the structure illustrated by FIG. 6 through resistive loss from circulating currents which at very high frequency flow only on the surfaces of electrodes.

The description of our invention has, for the sake of clarity, been referred to a type of electron gun, particularly a gridded gun, widely used in linear beam microwave tubes. The principle discovered is however useful for many other kinds of electron guns and therefore the preceding discussion is intended to be descriptive and not limiting.

We claim:

1. An electron gun comprising a plurality of electrodes shaped to generate a stream of electrons and direct said stream emergent from said gun, support means positioning said electrodes said support means including a member of direct current dielectric material forming an insulating support between two of said electrodes for maintaining a fixed spaced relationship therebetween, said material presenting high loss at radio frequencies so as to reduce the resonant impedance of at least one electromagnetic mode of said electrodes and said support means, said mode comprising fields interacting with the electron stream.

2. The apparatus of claim 1 where said electrodes comprise at least a cathode and an anode, at least part of the surface of said cathode being a thermionic electron source.

3. The apparatus of claim 1 wherein said electrodes comprise an electron emissive cathode, an anode, and at least one electron permeable grid electrode between said cathode and said anode.

4. The apparatus of claim 2 wherein said lossy material is positioned in a location shielded from high dc electric fields between said cathode and said anode.

5. The apparatus of claim 2 wherein the surfaces of said electrodes in the vicinity of said beam lie on shapes of revolution about a central axis.

6. The apparatus of claim 5 wherein said thermionic electron source is a concave surface of revolution, whereby said emerging electron stream has a diameter smaller than said emitter surface.

7. The apparatus of claim 3 wherein said two electrodes are said cathode and said grid.

* * * * *